US007676931B2

(12) United States Patent
Knight et al.

(10) Patent No.: US 7,676,931 B2
(45) Date of Patent: Mar. 16, 2010

(54) FOLDING KNIFE

(75) Inventors: Nathan E. Knight, Portland, OR (US); Glenn A. Klecker, Silverton, OR (US); John P. Nenadic, Camas, WA (US)

(73) Assignee: Leatherman Tool Group, Inc., Portland, OR (US)

( * ) Notice: Subject to any disclaimer, the term of this patent is extended or adjusted under 35 U.S.C. 154(b) by 709 days.

(21) Appl. No.: 11/153,639

(22) Filed: Jun. 14, 2005

(65) Prior Publication Data

US 2006/0277762 A1 Dec. 14, 2006

(51) Int. Cl.
*B26B 3/06* (2006.01)
*B26B 1/04* (2006.01)

(52) U.S. Cl. ..... 30/158; 30/159; 30/160; 30/161

(58) Field of Classification Search ..... 30/153, 30/159, 160, 158, 155, 337, 331, 161, 342, 30/338, 157, 519; 7/118–120, 900; 81/489
See application file for complete search history.

(56) References Cited

U.S. PATENT DOCUMENTS

| | | | | |
|---|---|---|---|---|
| 226,910 | A | 4/1880 | Friebertshauser | |
| 362,718 | A | 5/1887 | Brueckner | |
| 551,052 | A | 12/1895 | Shonnard et al. | |
| 616,689 | A * | 12/1898 | Ruettgers | 30/158 |
| 749,230 | A | 1/1904 | Severance | |
| 969,909 | A | 9/1910 | Schrade | |
| 1,454,665 | A | 5/1923 | Bobek | |
| 1,701,027 | A | 2/1929 | Brown | |
| 1,743,022 | A | 1/1930 | Carman | |
| 1,828,121 | A | 10/1931 | Adam et al. | |
| 2,250,290 | A | 7/1941 | Berg | |
| 2,263,415 | A | 11/1941 | Berg et al. | |
| 4,124,939 | A | 11/1978 | Onoue | |
| 4,342,410 | A | 8/1982 | Sloan | |
| 4,347,665 | A | 9/1982 | Glesser | |
| 4,404,748 | A | 9/1983 | Wiethoff | |
| 4,451,982 | A | 6/1984 | Collins | |
| 4,502,221 | A | 3/1985 | Pittman | |
| 4,563,813 | A | 1/1986 | Fortenberry | |
| 4,570,341 | A | 2/1986 | Konneker | |
| 4,716,797 | A | 1/1988 | Colvin | |

(Continued)

FOREIGN PATENT DOCUMENTS

| | | |
|---|---|---|
| CH | 277412 | 11/1951 |

(Continued)

*Primary Examiner*—Ghassem Alie
(74) *Attorney, Agent, or Firm*—Chernoff, Vilhauer, McClung & Stenzel, LLP

(57) ABSTRACT

A folding hand tool with an open-assist mechanism that is not mechanically linked to a folding knife blade is disclosed. The open-assist mechanism is allowed to rotate around the same pivot used by the blade, and includes a lug that interacts with the kick of the blade when rotated. Because the open-assist mechanism is not mechanically linked to the blade, it has a range of free motion that promotes safety, and allows the mechanism to rotate into the blade cavity when the blade is extended. The folding knife also may have a carabiner that shares the blade cavity with the blade, with the blade nesting into the carabiner to save space, thereby giving the folding knife a smaller profile.

45 Claims, 9 Drawing Sheets

U.S. PATENT DOCUMENTS

| | | | | |
|---|---|---|---|---|
| 4,719,700 | A | 1/1988 | Taylor, Jr. | |
| 4,741,106 | A | 5/1988 | Yamagishi | |
| 4,776,094 | A | 10/1988 | Glesser | |
| 4,805,303 | A | 2/1989 | Gibbs | |
| 4,811,486 | A | 3/1989 | Cunningham | |
| 4,837,932 | A | 6/1989 | Elsener | |
| 4,874,905 | A | 10/1989 | Schnell et al. | |
| 4,896,424 | A | 1/1990 | Walker | |
| 4,947,552 | A | 8/1990 | Barnes | |
| 4,974,323 | A | 12/1990 | Cassady | |
| 4,979,301 | A | 12/1990 | Walker | |
| 5,044,079 | A | 9/1991 | Gibbs | |
| 5,060,379 | A | 10/1991 | Neely | |
| 5,095,624 | A | 3/1992 | Ennis | |
| 5,111,581 | A | 5/1992 | Collins | |
| 5,245,721 | A | 9/1993 | Lowe et al. | |
| 5,251,353 | A | 10/1993 | Lin | |
| 5,270,909 | A | 12/1993 | Weiss et al. | |
| 5,280,659 | A | 1/1994 | Park | |
| 5,293,690 | A | 3/1994 | Cassady | |
| 5,317,940 | A | 6/1994 | Shun'ko | |
| 5,331,741 | A * | 7/1994 | Taylor, Jr. | 30/158 |
| 5,349,753 | A | 9/1994 | Gaffney | |
| 5,400,509 | A | 3/1995 | Collins | |
| 5,437,101 | A | 8/1995 | Collins | |
| 5,450,670 | A | 9/1995 | Sakai | |
| 5,463,798 | A | 11/1995 | Wurzer | |
| D365,266 | S | 12/1995 | Hasegawa | |
| 5,495,673 | A | 3/1996 | Gardiner et al. | |
| 5,502,895 | A | 4/1996 | Lemaire | |
| 5,515,610 | A | 5/1996 | Levin et al. | |
| 5,537,750 | A | 7/1996 | Seber et al. | |
| 5,615,484 | A | 4/1997 | Pittman | |
| 5,628,117 | A | 5/1997 | Glesser | |
| 5,689,885 | A | 11/1997 | Walston | |
| 5,692,304 | A | 12/1997 | Campbell | |
| 5,737,841 | A | 4/1998 | McHenry et al. | |
| 5,755,035 | A | 5/1998 | Weatherly | |
| 5,765,247 | A | 6/1998 | Seber et al. | |
| 5,781,950 | A | 7/1998 | Swinden et al. | |
| 5,802,722 | A | 9/1998 | Maxey et al. | |
| 5,809,600 | A | 9/1998 | Cachot | |
| 5,815,927 | A | 10/1998 | Collins | |
| 5,822,866 | A | 10/1998 | Pardue | |
| 5,822,867 | A | 10/1998 | Sakai | |
| 5,826,340 | A | 10/1998 | Hull | |
| 5,829,329 | A | 11/1998 | Frazer | |
| 5,887,347 | A | 3/1999 | Gibbs | |
| 5,896,665 | A | 4/1999 | Harris | |
| 5,946,752 | A | 9/1999 | Parrish | |
| 5,964,036 | A | 10/1999 | Centofante | |
| 5,979,059 | A | 11/1999 | Leatherman et al. | |
| 5,983,686 | A | 11/1999 | Lee | |
| 6,079,106 | A | 6/2000 | Vallotton | |
| 6,101,724 | A | 8/2000 | Halligan | |
| 6,105,255 | A | 8/2000 | Cheng | |
| 6,112,352 | A | 9/2000 | Legg | |
| 6,122,829 | A | 9/2000 | McHenry et al. | |
| 6,145,202 | A | 11/2000 | Onion | |
| 6,145,851 | A | 11/2000 | Heber | |
| 6,151,999 | A | 11/2000 | Eklind | |
| 6,170,104 | B1 | 1/2001 | Seber et al. | |
| 6,223,372 | B1 | 5/2001 | Barber | |
| 6,233,769 | B1 | 5/2001 | Seber et al. | |
| 6,256,887 | B1 | 7/2001 | Osborne | |
| 6,282,997 | B1 | 9/2001 | Frazer | |
| 6,286,397 | B1 | 9/2001 | Taggart et al. | |
| 6,308,420 | B1 | 10/2001 | Moser | |
| 6,360,443 | B1 | 3/2002 | Remus | |
| 6,389,625 | B1 | 5/2002 | Rivera | |
| 6,397,476 | B1 | 6/2002 | Onion | |
| 6,397,477 | B1 | 6/2002 | Collins | |
| 6,438,848 | B1 | 8/2002 | McHenry et al. | |
| 6,438,849 | B1 | 8/2002 | Wonderley | |
| 6,442,843 | B1 | 9/2002 | Jue et al. | |
| 6,484,341 | B2 | 11/2002 | Hefti et al. | |
| 6,487,941 | B1 | 12/2002 | Ping | |
| 6,490,797 | B1 | 12/2002 | Lake et al. | |
| 6,510,767 | B1 | 1/2003 | Rivera | |
| 6,553,671 | B2 | 4/2003 | Blanchard | |
| D474,095 | S | 5/2003 | Luquire | |
| 6,560,873 | B1 | 5/2003 | Ortner et al. | |
| 6,574,869 | B1 * | 6/2003 | McHenry et al. | 30/161 |
| 6,591,504 | B2 | 7/2003 | Onion | |
| 6,594,906 | B1 | 7/2003 | Sakai et al. | |
| 6,618,946 | B2 | 9/2003 | Seraphin | |
| 6,618,947 | B1 | 9/2003 | Gardiner et al. | |
| D480,492 | S | 10/2003 | Wu | |
| 6,651,344 | B2 | 11/2003 | Cheng | |
| D484,770 | S | 1/2004 | Green | |
| 6,675,484 | B2 | 1/2004 | McHenry et al. | |
| 6,684,510 | B1 | 2/2004 | Collins | |
| 6,711,820 | B2 | 3/2004 | Chen | |
| 6,941,604 | B2 | 9/2005 | Ackeret | |
| 6,983,505 | B2 | 1/2006 | McIntosh et al. | |
| 2001/0016987 | A1 | 8/2001 | Chen | |
| 2002/0029426 | A1 | 3/2002 | Seber et al. | |
| 2002/0095792 | A1 | 7/2002 | Jue et al. | |
| 2004/0020057 | A1 | 2/2004 | Hughes | |
| 2004/0020058 | A1 | 2/2004 | Vallotton | |
| 2004/0040120 | A1 | 3/2004 | Zaidman | |
| 2004/0064953 | A1 | 4/2004 | Cheng | |
| 2004/0078981 | A1 | 4/2004 | Cheng | |
| 2004/0088865 | A1 | 5/2004 | Onion | |
| 2004/0244205 | A1 * | 12/2004 | Linn et al. | 30/159 |
| 2005/0177954 | A1 | 8/2005 | Smith | |
| 2006/0260138 | A1 * | 11/2006 | VanHoy | 30/161 |
| 2006/0272158 | A1 * | 12/2006 | Williams | 30/161 |
| 2007/0157771 | A1 | 7/2007 | Rivera | |
| 2007/0209121 | A1 | 9/2007 | Rivera | |
| 2007/0294833 | A1 | 12/2007 | Rivera et al. | |

FOREIGN PATENT DOCUMENTS

| | | |
|---|---|---|
| CH | 689257 | 1/1999 |
| EP | 0100377 | 2/1984 |
| EP | 0714736 | 6/1996 |
| FR | 2 782 287 | 2/2000 |
| GB | 2190321 | 11/1987 |

* cited by examiner

FOLDING KNIFE

FIELD OF THE INVENTION

The present invention generally relates to hand tools, and in particular to tools wherein a cutting implement may be folded into a handle for improved storability and improved safety.

BACKGROUND OF THE INVENTION

Folding knives, or so-called pocket knives, have been around for over a hundred years and are well known in the art. Initially, folding knives were a single blade housed between two handle portions and rotatable around a pivot point such as a screw or rivet at one end of the handle. During use, the blade is rotated approximately 180 degrees such that the blade extends from the handle and the blade and handle share a common longitudinal plane. The handle and tang end of the blade come in contact to prevent the blade from over-rotating and to provide a solid cutting implement. For storage, the blade is rotated the opposite direction the same approximate 180 degrees, and stored in a cavity within the handle. With the blade stored, the overall length of the knife is approximately 40% shorter, thereby allowing for convenient storage in, for example, a pocket. The small size of such a knife makes it desirable as a portable and efficient means of having a cutting implement available at all times.

Over time, many improvements have been made to the basic pocket knife premise to improve both function and aesthetics. For example, one or more additional blades have been added to provide options for blade shape, size, and utility. Additionally, other implements and tools have been added, up to and including eating utensils, flashlights, cork screws, screwdrivers, lanyards, scissors, and a seemingly endless myriad of other useful tools. As one might expect however, the addition of tools adds to the overall size of the folding knife, thereby decreasing the ease of storage, and potentially the desirability of carrying the knife in the first place. The result is a give-and-take analysis where one must prioritize the function and use frequency of each potential tool, and then weigh that against the physical size of the tool and how it will be carried by the user. This general development has also led to other useful items incorporating a folding knife blade into them. For example, carabiners, flashlights, key chains, etc. have been modified to have a blade contained somewhere within their respective frames.

Another general area of improvement has been in the opening of the knife blade. Originally, the blade had a recess cut into the side of the blade where a fingernail could catch and extract the blade from its stored position. The need and/or desire for the ability to open a blade using only one hand spurred a number of competing modifications, such as a thumb stud mounted on the side of the blade, a portion of the blade tang protruding out of the handle, or even a button released spring-assisted opening mechanism. Some of these mechanisms that exert stored potential energy on the blade and eject the blade from the storage cavity at high speed have been classified as illegal weapons and subsequently outlawed in some, but not all, jurisdictions. This causes considerable problems for a person who may legally carry such a knife in his own jurisdiction, and therefore without thinking carries it into another jurisdiction where it has been outlawed. One common feature though, is the placement of a release button or operating lever for a blade-opening device. Traditional placement of such mechanisms has been on the side of the blade or on the side of the handle, enlarging the tool and potentially providing a point where clothing or other items can be snagged or caught on the mechanism.

Although there are many options in the folding knife technology area, there is an ongoing desire to improve space efficiency and use of such knives. What is desired then, is an improved knife that maximizes space utilization, and that provides a mechanism for easily opening a blade with one hand while minimizing the size of the mechanism and optimizing its location.

SUMMARY OF THE INVENTION

The present invention addresses the previously mentioned shortcomings of the prior art and addresses the aforementioned desired features by providing a folding tool including improvements in space utilization such that a blade and an additional tool can share the same blade cavity in a coaxial or coplanar fashion, without causing the knife to be substantially longer than a single-blade knife of similar size and shape.

In a folding tool including an embodiment of one aspect of the invention, a carabiner lies generally coplanar with a blade. A portion of the carabiner defines a slot along the longitudinal axis in such a way that the blade can rest within the slot. In this embodiment, the carabiner rotates around one end pivot and exits the blade cavity from the top of the blade cavity, and the knife blade rotates around a pivot axis at the other end of the tool and exits from the bottom of the blade cavity such that both the knife blade and the carabiner rotate in the same direction relative to the tool handle to open from the handle (i.e. both rotate clockwise rather than one rotating clockwise and the other rotating counter-clockwise). This configuration allows for the independent opening of each of the blade and carabiner such that both the blade and the carabiner may be stored, either one of them stored and the other opened, or both may be opened at the same time. Furthermore, the opening and closing of each is completely independent of, and has no effect whatsoever on the other.

In an alternative tool which is an embodiment of an aspect of the invention, a carabiner again lies generally coplanar with a blade. In this embodiment, however, the carabiner enters and exits the blade cavity at one end of the handle by sliding along the longitudinal axis of the handle. When the carabiner is slid into the blade cavity, a gate of the carabiner is forced into the retracted or open position, and the end of the knife blade occupies space created by retracting the carabiner gate. The knife blade exits the blade cavity by rotating around a pivot at the other end of the knife handle. Again, although the carabiner and the knife blade share space in the blade cavity, each may be deployed or stored without any effect on the other.

In yet another folding tool which is an embodiment of an aspect of the invention, an open-assist flipper is utilized to provide a novel method of opening the blade with one hand. The open-assist flipper is placed at the end of the knife and is completely, or almost completely, housed within the blade cavity. The open-assist flipper has a finger stud that sticks out toward the end of the knife in the gap between the two sides of the handle, and rotates around the same pivot axis as the knife blade, but the flipper is not mechanically linked to the knife blade. Rather, by rotating the finger stud around the pivot point, a flange, or lug, on the open-assist flipper body is made to contact the tang end of the blade at the blade kick, causing the blade to rotate out of the cavity. Since the open-assist flipper is not attached to the blade, it can be rotated back to its original position thereafter without causing the blade to be returned to the knife cavity. It also provides some controlled play such that if the lever gets snagged on an article of clothing or the like, it can rotate around the pivot point a certain amount without causing the blade to be deployed.

Other embodiments exist where more than one set of coplanar tools is desired. One such embodiment includes a coplanar knife blade and carabiner as explained above, coupled with another set of coplanar tools such as, for example, a can opener and a bit driver. In this embodiment, additional bits are stored in a recess in one handle of the knife. The bit driver and bits are designed to have a thin profile similar to the thickness of the blade used, yet still provide useful tools such as a four-bladed #2 Phillips head screwdriver; a tool typically not associated with such a thin structure. It is even conceivable that the various embodiments may be utilized with a folding tool that only has one elongate handle half as opposed to two handle halves by simple modifications.

The foregoing few embodiments mentioned out of the many possible embodiments available, along with other objectives, features, and advantages of the invention will be more readily understood and appreciated upon consideration of the following detailed description taken in conjunction with the accompanying drawings.

DETAILED DESCRIPTION OF EMBODIMENTS OF THE INVENTION

Figure 1:
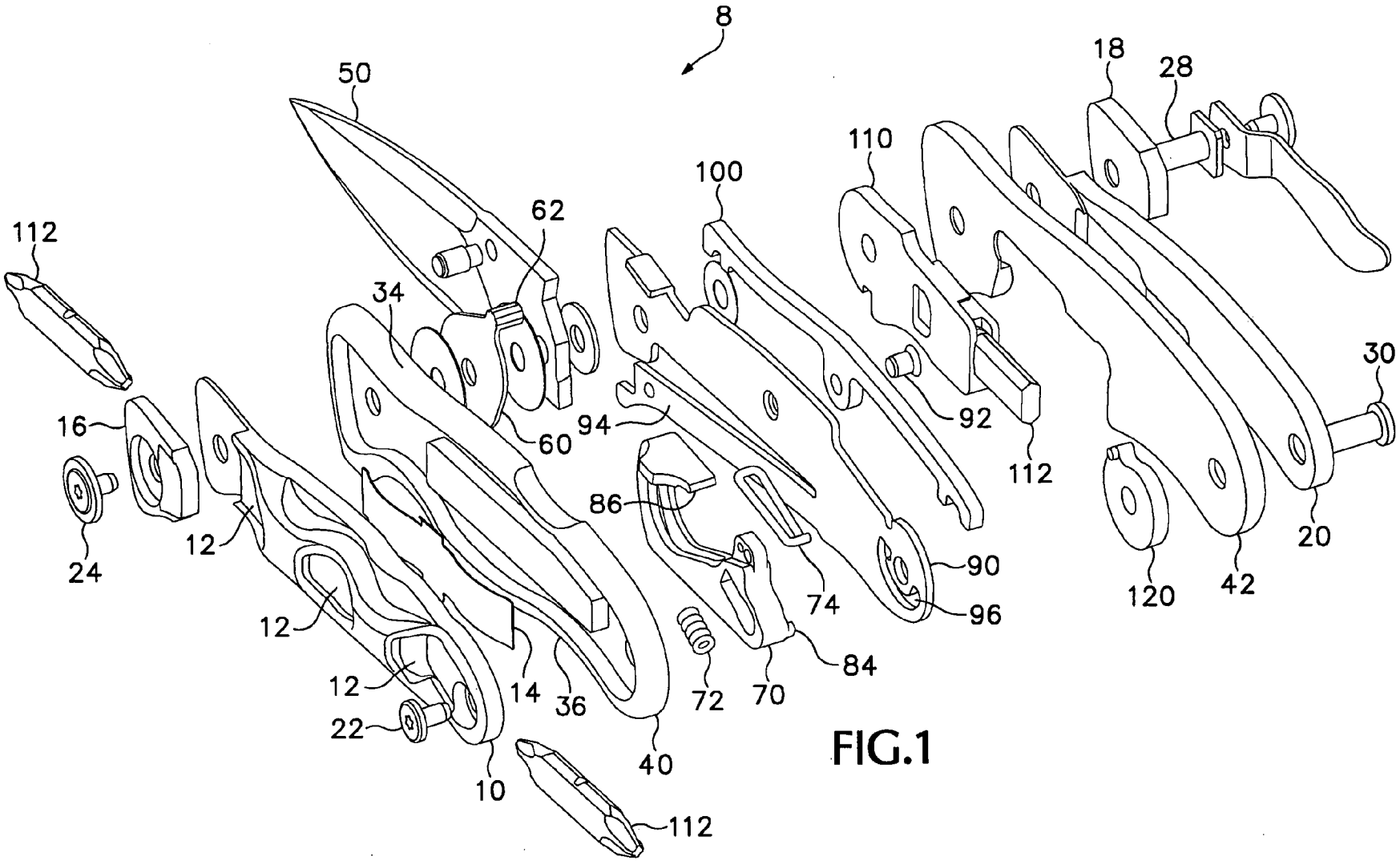
FIG. 1 is an exploded isometric view of a folding hand tool that is an exemplary embodiment of an aspect of the present invention.

Referring now to the drawing figures, wherein like reference numerals represent like parts throughout the several figures, FIG. 1 shows an exploded view of a tool 8 including a folding knife of one embodiment of the present invention. The knife of this embodiment contains a pair of scales 10, 20 including the outer surfaces of the knife. Scale 10 defines a cavity within its body frame having outwardly facing openings, generally shown at 12, wherein one or more interchangeable bits 112 can be stored, yet can easily be extracted for use as needed. A bit retention spring 14 exerts a lateral force on the interchangeable bits 112 to secure them when being stored. The bit retention spring 14 is fitted into a recess (not shown) in scale 10, and is secured by frame 40, which provides resistance for the spring 14 to act upon when the tool 8 is assembled. Optionally, scale 10 and frame 40 can be manufactured as one part to serve the functions of both parts, as can be scale 20 and frame 42.

When assembled, the folding tool 8, including scales 10 and 20, bolsters 16 and 18, frames 40 and 42, open-assist flipper 60, blade 50, carabiner 70, liner plate 90, bit driver 110, and spacer 120 are secured by mated blade fasteners 24 and 28 at one end and by similar fasteners 22 and 30 at the other end. Blade fasteners 28 and 30 also act as pivots for the open-assist flipper 60, the knife blade 50, the carabiner 70, and the bit driver 110.

The handle thus has a pair of opposite first and second ends, a top margin 34 and a bottom margin 36. In the embodiment shown, spacer 120 does not rotate about blade fastener 30, but in other embodiments not shown the spacer 120 could be replaced with other useful tools such as a can opener, screw driver, blade, file, saw, scissors, awl, punch, or tweezers, that would then rotate about blade fastener 30. It should be equally obvious that bit driver 110 could be replaced with any such tool, thus giving almost limitless options and permutations of various tools as desired.

A spring 100, fixedly attached to liner plate 90 by a fastener 92 such as a rivet, screw, brad, detent, or other such means, provides a biasing force on the bit driver 110, biasing it toward either the closed position or the open position depending on the rotational location of the bit driver 110, such that it urges a closed driver to stay closed, and an open driver to stay open.

Figure 2:
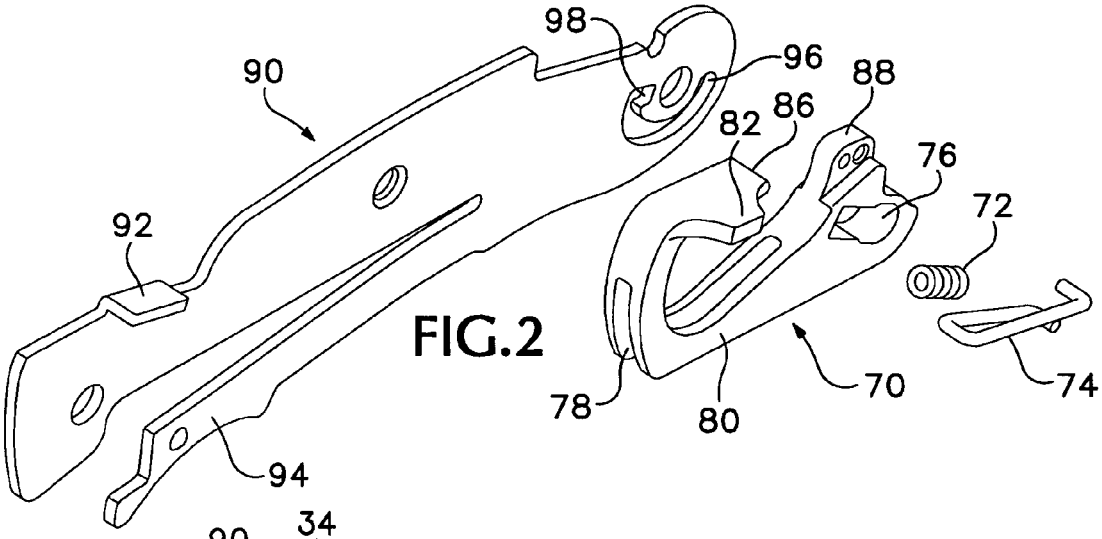
FIG. 2 is an exploded perspective view of the pivotable carabiner included in the tool shown in FIG. 1.
Figure 3:
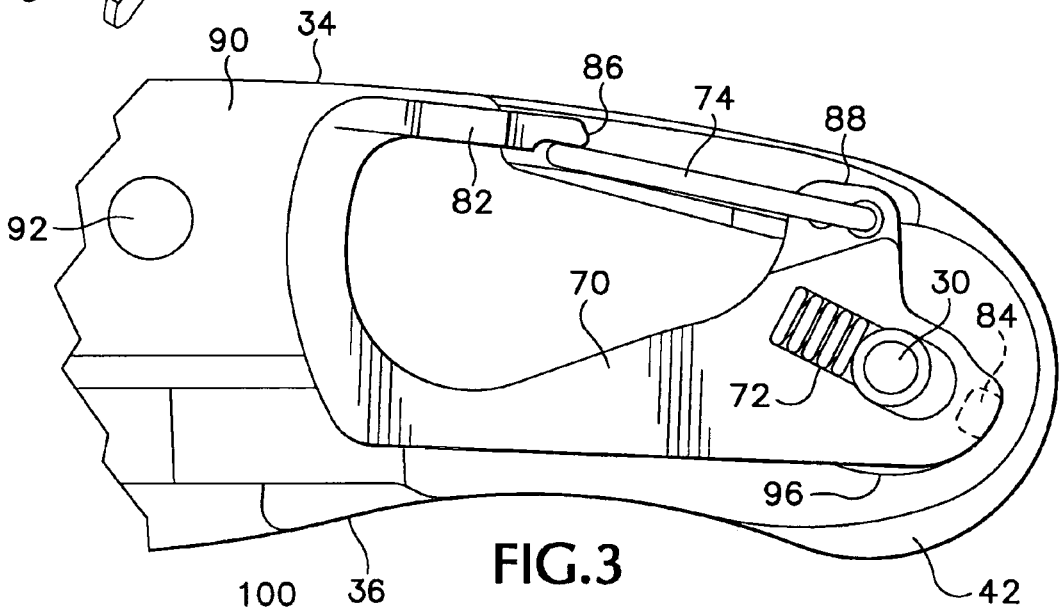
FIG. 3 is an elevational view of a portion of the hand tool, including the pivotable carabiner shown in FIG. 2, in the closed or retracted position.
Figure 4:
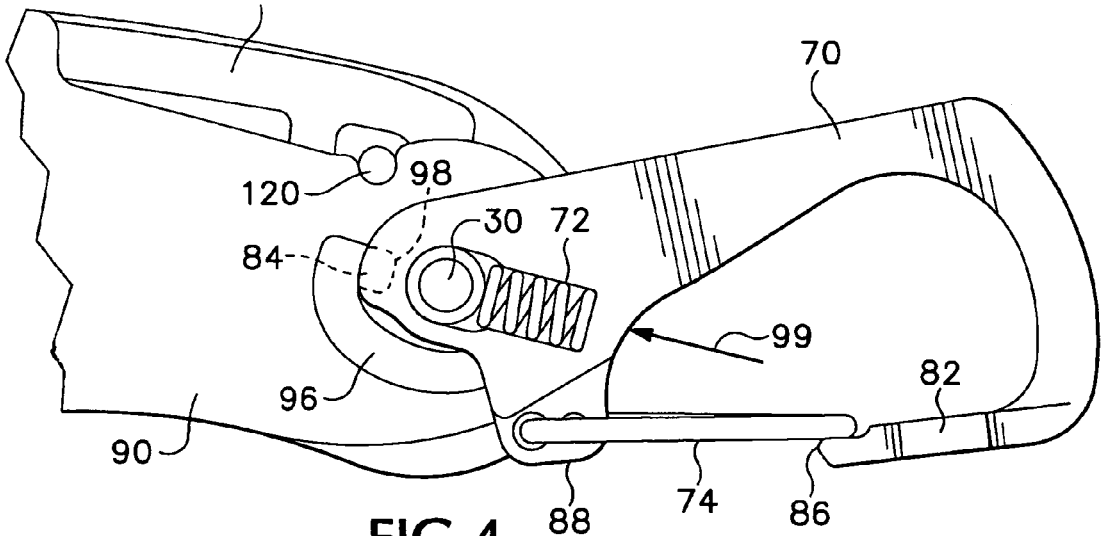
FIG. 4 is a view of the portion of the tool shown in FIG. 3, with the pivotable carabiner shown in FIG. 2 in the extended or open position.
Figure 5:
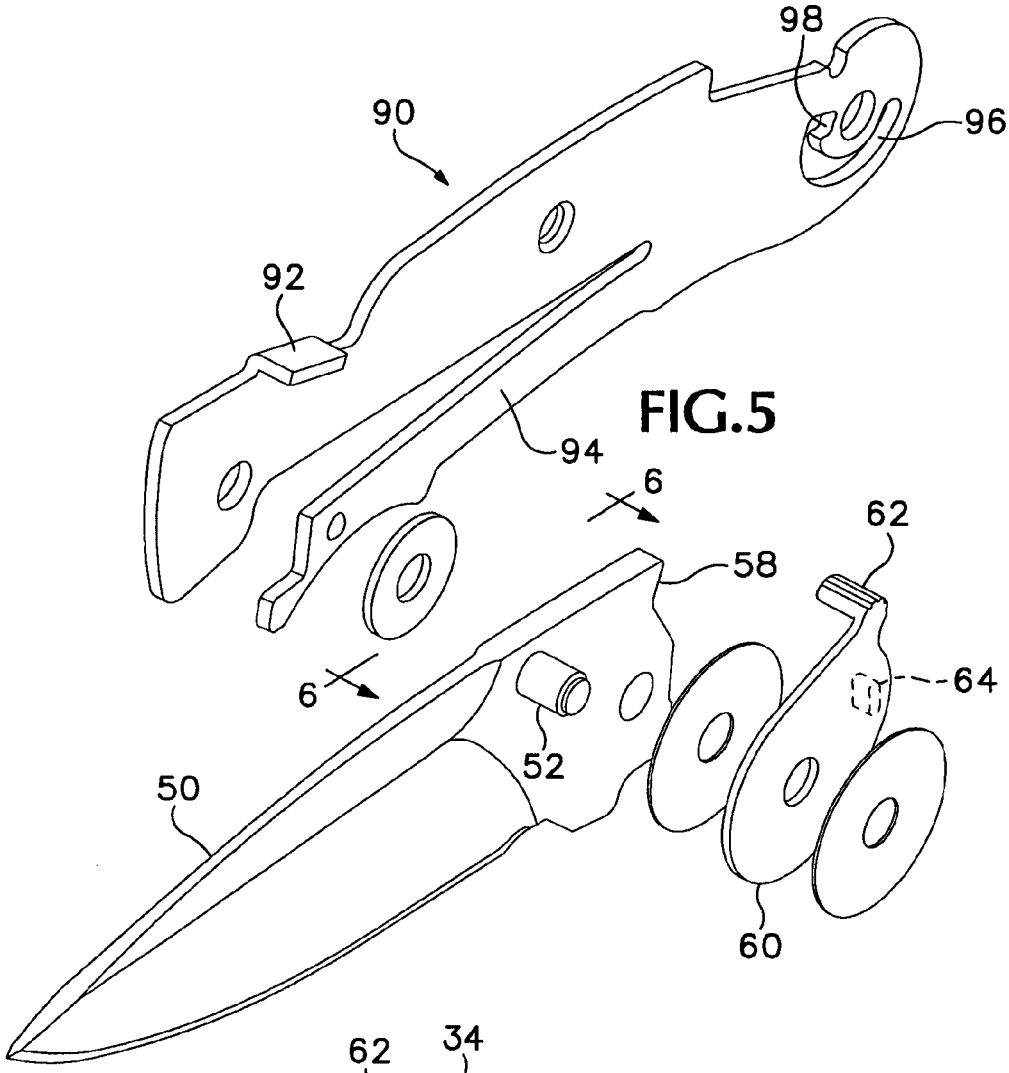
FIG. 5 is an exploded isometric view of the knife blade of the tool shown in FIG. 1, together with an open-assist mechanism according to another embodiment of one aspect of the present invention.
Figure 8:
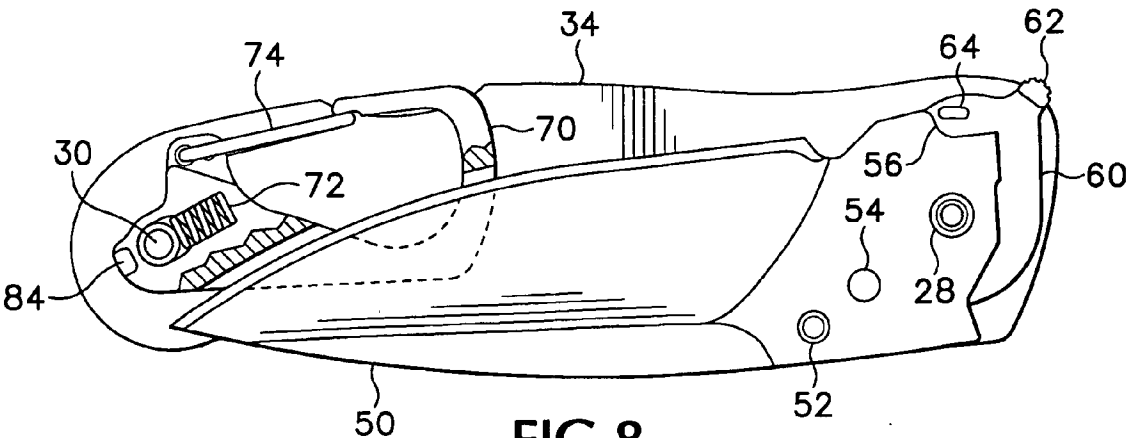
FIG. 8 is a partially cutaway view of the folding knife shown in FIG. 7, with a blade and a carabiner in closed positions and the blade nested within the carabiner.

A carabiner 70 is located between liner plate 90 and frame 40, and is pivotally mounted on and rotatable around blade fastener 30. As shown in FIGS. 2-4, carabiner 70 has a frame 80 in the form of a hook, and that defines a recess 78 cut into the frame 80 for receiving a portion of the knife blade 50 when the carabiner 70 is in the retracted position, as shown in FIG. 8. The carabiner 70 includes a spring gate 74 for closing the loop of the carabiner. It should be noted that the gate may alternately be a sliding gate, a bending gate, or a pivoting gate, as is known in the art. The carabiner 70 has a laterally projecting lock dog 84, that is received in and slides around the blade fastener 30 in carabiner spring slot 96 defined in the liner plate 90. A carabiner lock recess 98 is located at one end of carabiner guide slot 96. The carabiner 70 has a spring recess 76 through which the blade fastener 30 extends, and the carabiner 70 pivots around the blade fastener 30. The spring recess 76 also contains a spring 72 in compression and pushing outwardly against the blade fastener 30. When the carabiner is rotated to its fully opened position, the spring 72 forces the carabiner 70 outward, longitudinally of the handle of the tool 8 so that the lock dog 84 is pushed into the carabiner lock recess 98, thereby locking the carabiner 70 in the open position. In order for the carabiner to then be released, an axial force in the inward longitudinal direction, as indicated by arrow 99 in FIG. 4, and greater than the force exerted by the spring 72, must be applied to press the lock dog 84 out of the lock recess 98, upon which the carabiner 70 is then rotated to its closed position. It should be obvious that other lock mechanisms, such as liner locks known in the art, could be substituted for the lock mechanism as described. The carabiner 70 also has an opening flange 82 that allows the carabiner to be opened with one hand from its retracted position.

The carabiner 70 may optionally contain a mechanism (not shown) to hold the gate 74 open as needed, so that the carabiner could be used as a hook rather than a secured locking mechanism. Additionally, when the carabiner 70 is in the fully opened position it may be used to open a bottle. When the carabiner frame 80 is placed over a bottle cap the spring gate 74 rotates open allowing the end 86 of the frame 80 to hook under the flanges of a crimped bottle cap. The gate base portion 88 of carabiner 70 then acts as a fulcrum for prying the cap from the bottle.

Figure 6:
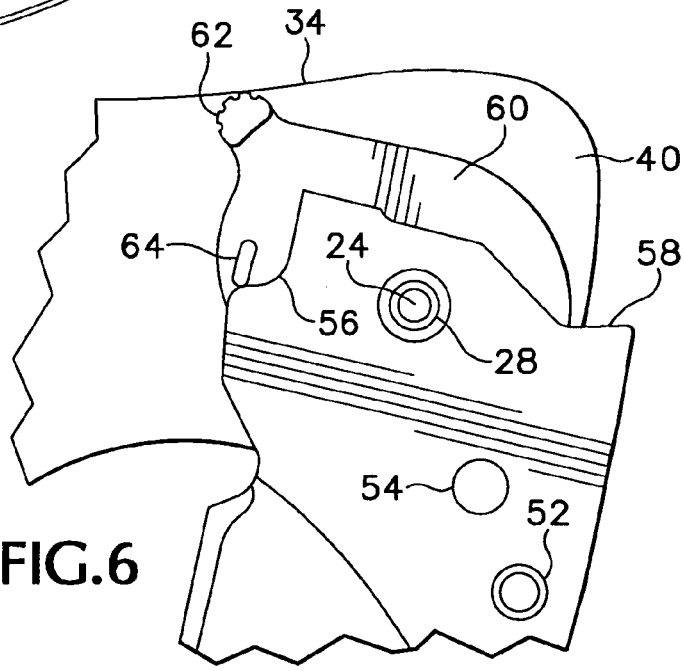
FIG. 6 is an elevational view taken in the direction indicated by line 6-6 in FIG. 5, showing a detail of the open-assist mechanism shown in FIG. 5, assembled with a blade partially opened and showing the interaction between the open-assist mechanism and the blade.
Figure 7:
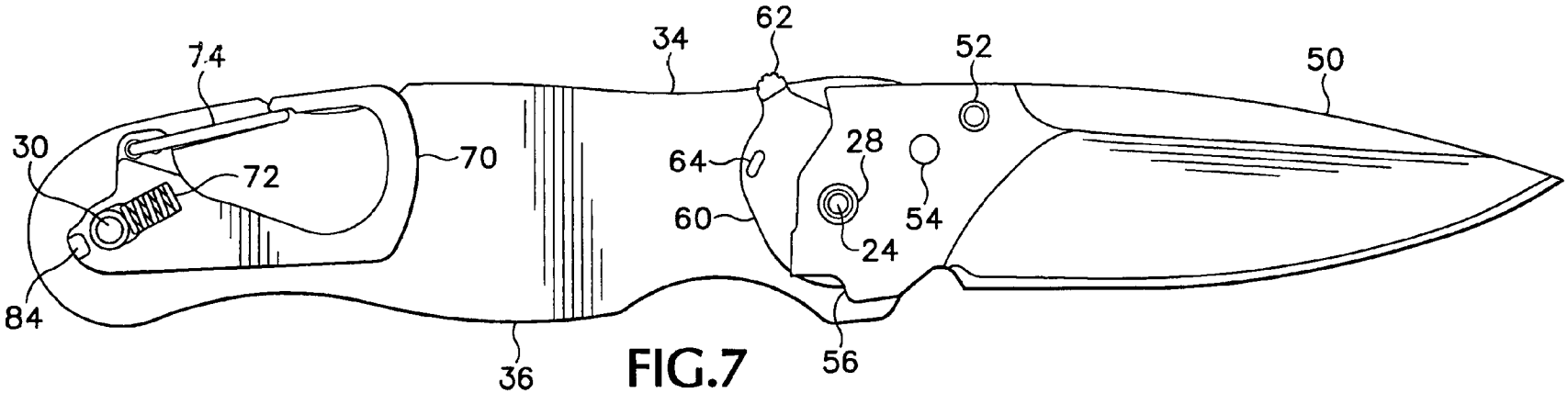
FIG. 7 is an elevational or side view of a folding knife similar to a part of the tool shown in FIG. 1, with a side of the handle removed, and with the knife blade in the open position and a carabiner in the closed or retracted position.

On the end of the tool 8 opposite the carabiner 70, an open-assist flipper 60 is provided, as shown in FIGS. 5-8. The flipper 60 is principally a thin plate mounted on the blade fastener 28. The flipper 60 and the blade 50 can rotate around and pivot on blade fastener 28 in this embodiment, although alternatively the open-assist flipper 60 could be mounted so as to move about its own pivot placed in the frame 40, for example. The flipper 60 has a finger stud 62 that extends outside the confinement of the handle by a small distance. The finger stud is rotated rearwardly, or counterclockwise as seen in FIGS. 6-8, by the user's finger so that as shown in FIG. 6 a laterally projecting lug 64 contacts and exerts a force on blade kick 56, causing the blade 50 to rotate out of the blade cavity to the extended and locked position shown in FIG. 7. The blade 50 has a blade detent 54 that interacts with either the frame 40 or the liner lock spring 94 to retain the blade 50 in the closed position. As a result, when opening the blade 50 using the flipper 60, the flipper must overcome the biasing force of the detent 54 before the blade will open. This provides a safety mechanism in that the blade must overcome a specific force before it opens, thereby reducing the risk of accidental opening. As an additional safety feature as best seen in FIG. 8, the flipper 60 has a considerable rotational angle through which it can rotate away from the blade kick 56 so that the flipper 60 can be rotated forward around the corner of the handle 40 to a position where the finger stud 62 is partially or completely recessed within the area between the handle 40 and the liner plate 90. In this forward position the flipper 60 is less likely to apply an inadvertent opening force to the blade 50 by being bumped or snagged on an item. It should also be noted that the finger stud 62 of the flipper 60 can recess into the space between the handle frame member 40 and the liner plate 90 so that it may be completely out of the way of the exterior grip surfaces of the handle when the blade 50 is extended, thus improving comfort, as best seen in FIG. 6. When the blade 50 is then rotated into its stored position, the blade kick 56 forces the finger stud 62 of the flipper 60 outside of the handle area, and into an area that can be reached by a finger.

Optionally, the open-assist flipper 60 may contain a spring mechanism (not shown) to assist in opening the blade more quickly. In such a case, the spring may be located between the blade kick 56 and the lug 64, or may be an integral part of the flipper itself. The spring may be in the form of a coil spring, a leaf spring, a resiliently deformable material, or other spring mechanisms known in the art. In the case when a spring assist is used, an interlock, blade detent, or some other form of resistance known in the art, retains the blade in the closed position, and only when sufficient force is applied to the flipper 60 and thus the spring mechanism to overcome the resistance will the blade 50 open. This resistance can obviously be designed to be as small or as large as desired. It is important to note that if a spring mechanism is employed in such a manner, because of the rotational freedom of the open-assist flipper 60 to move away from the blade kick 56, there would normally be effectively no stored potential energy held by the spring, unless the open-assist flipper is being urged to open the blade 50. This is important as a safety feature, because the knife blade 50 thus would not spring open accidentally. Such an arrangement of the spring also would exclude the knife from the definition of a switchblade, since there is no "release mechanism" whereby stored potential energy is released, causing the blade to open. Nevertheless, along the lines of a standard switchblade, the open-assist flipper 60 could optionally contain a blade lock arranged in such a way that when the flipper is rotated to a certain location, a lock mechanism physically prevents the blade from being opened, adding another degree of safety.

The blade 50 may also have a standard opening feature such as a thumb stud 52, or other devices commonly used such as a nail groove or the like. The open-assist flipper 60 will not interfere with or restrict the use of these other methods of opening the knife blade. The blade 50 may also have a lock mechanism, such as the liner lock wherein the outer end of the liner lock spring 94 engages the kick 56 and holds the blade 50 firmly in the open position until the liner lock spring 94 is released, allowing the blade 50 to return to the closed position. Optionally, the open-assist flipper 60 may incorporate another mechanism (not shown) that could release the liner lock 94 when the flipper 60 is rotated, allowing the blade to be closed. Although a liner lock 94 is shown, other lock mechanisms known in the art may be utilized in conjunction with the open-assist flipper 60. It should also be noted that this embodiment discloses the use of the open-assist flipper 60 on the blade 50, but such an open-assist flipper 60 may be used to open any tool selected to be incorporated into the knife. Similarly, multiple flippers may be utilized within one folding tool 8, so that up to each blade or bit of the tool may have its own flipper. In this instance, the multiple flippers may be staggered or a selection device may be utilized such that one flipper can open any one of the tools, as selected by the user.

Figure 10:
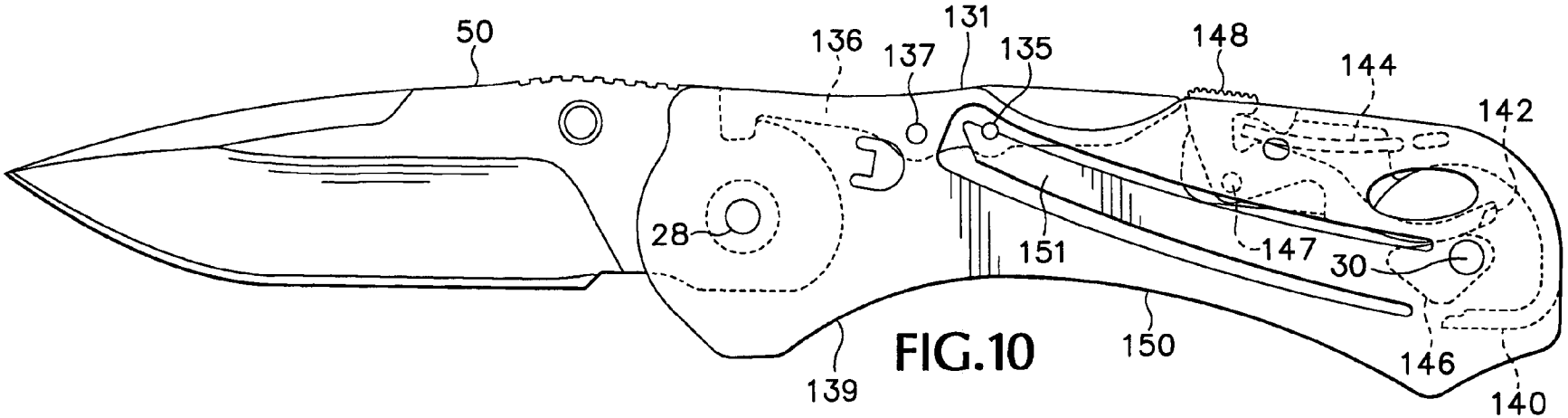
FIG. 10 is a side elevational view of a folding knife portion of the tool shown in FIG. 9, with the knife blade in the open position and the sliding carabiner in the closed or retracted position.
Figure 11:
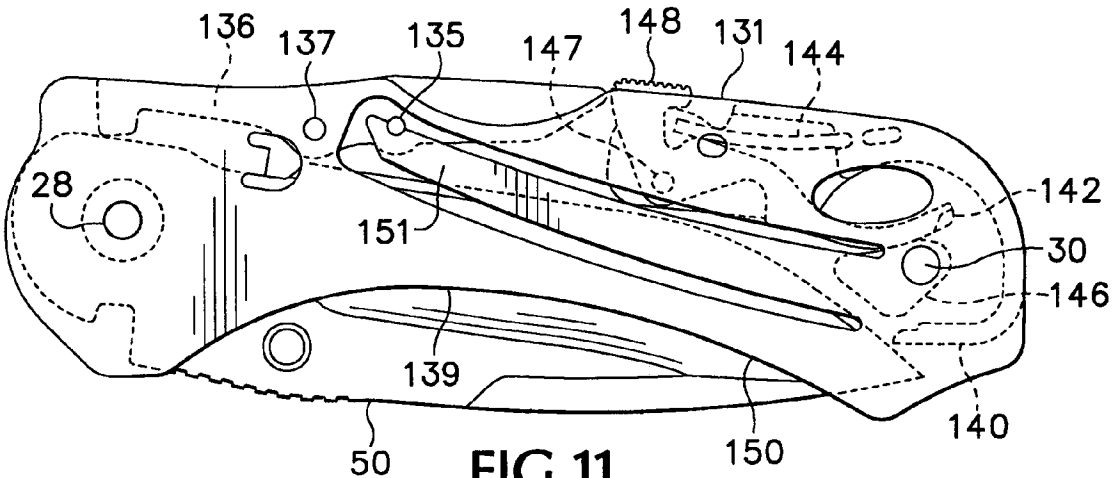
FIG. 11 is a side elevational view of the folding knife shown in FIG. 10, with the knife blade and sliding carabiner both in the closed positions.
Figure 12:
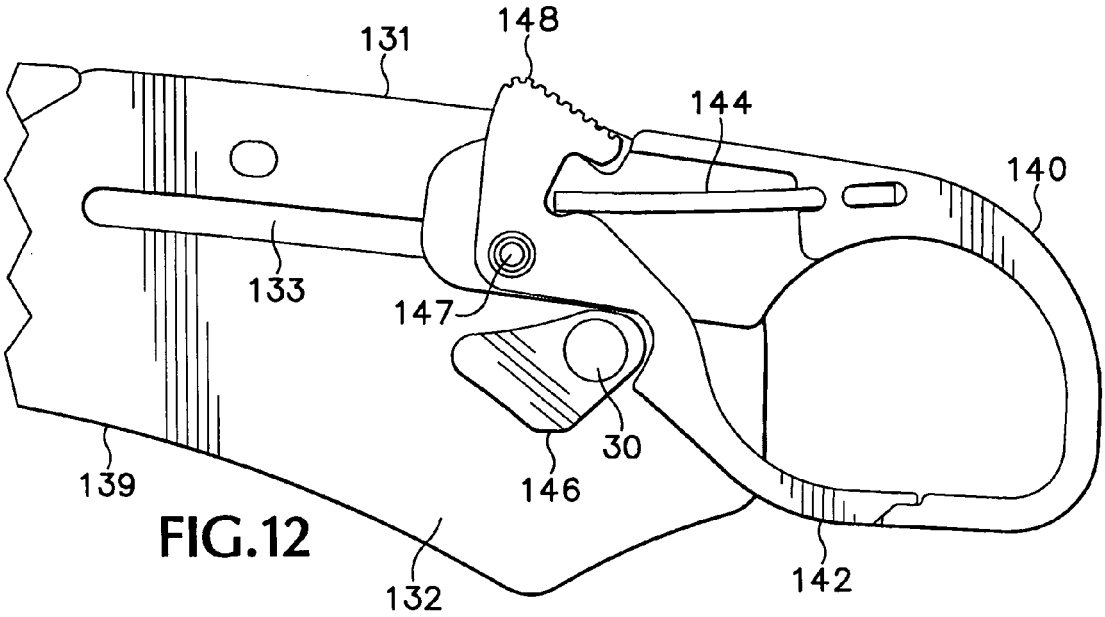
FIG. 12 is a side elevational view of a portion of the folding knife shown in FIGS. 9-11, with the sliding carabiner in the extended or open position.
Figure 13:
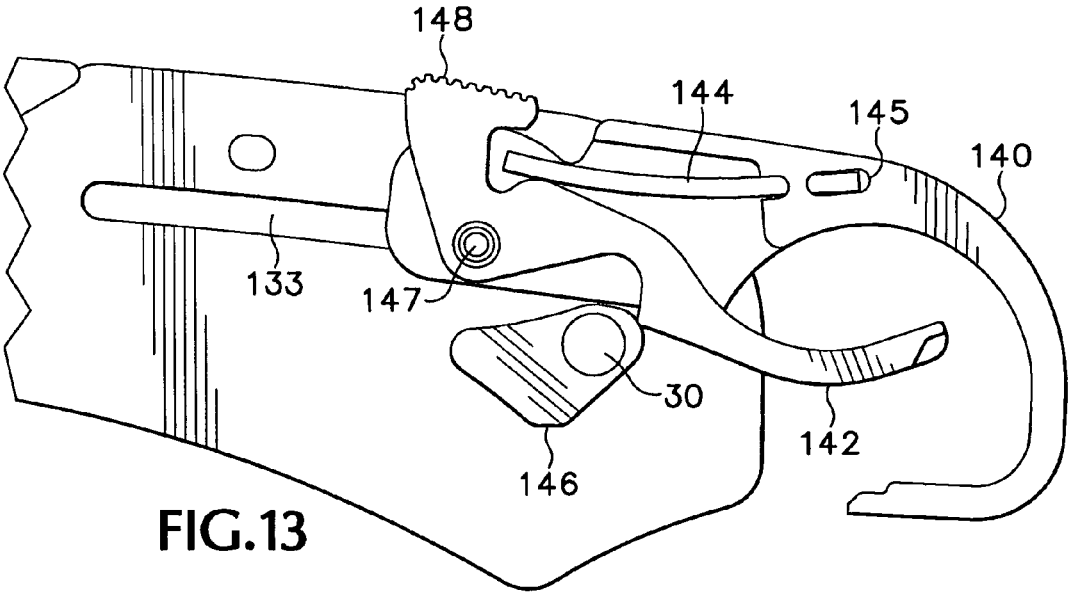
FIG. 13 is a view of the portion of a tool shown in FIG. 12, with the sliding carabiner partially retracted from the extended or open position, and with the thumb retractor opening the gate partially opened.

Referring now to FIGS. 9-15, a folding knife 130 including a second embodiment of certain features is shown. Specifically, an alternative carabiner 138 is provided. In this embodiment, the carabiner contains a frame 140 and a gate 142. The gate 142 pivots on a gate hinge 147, and a thumb retractor 148 extends away from the hinge in a different direction. A gate spring 144 mounted in a socket 145 or equivalent receptacle in the frame 140 of the carabiner biases the gate 142 toward the closed position by pressing on the gate 142 to urge it downward as shown in FIG. 12, thus rotating the thumb retractor 148 to the right. The gate 142 can be opened by pushing directly on the gate, or by using a thumb or finger to force the thumb retractor 148 to the left, as seen in FIGS. 12 and 13. The gate 142 lies substantially co-planar with the knife blade 50 in the blade cavity 132, defined between the liner plate 134 and the frame plate 150 of the handle and open along the bottom margin 139 of the handle to receive the folding knife blade 50.

Figure 14:
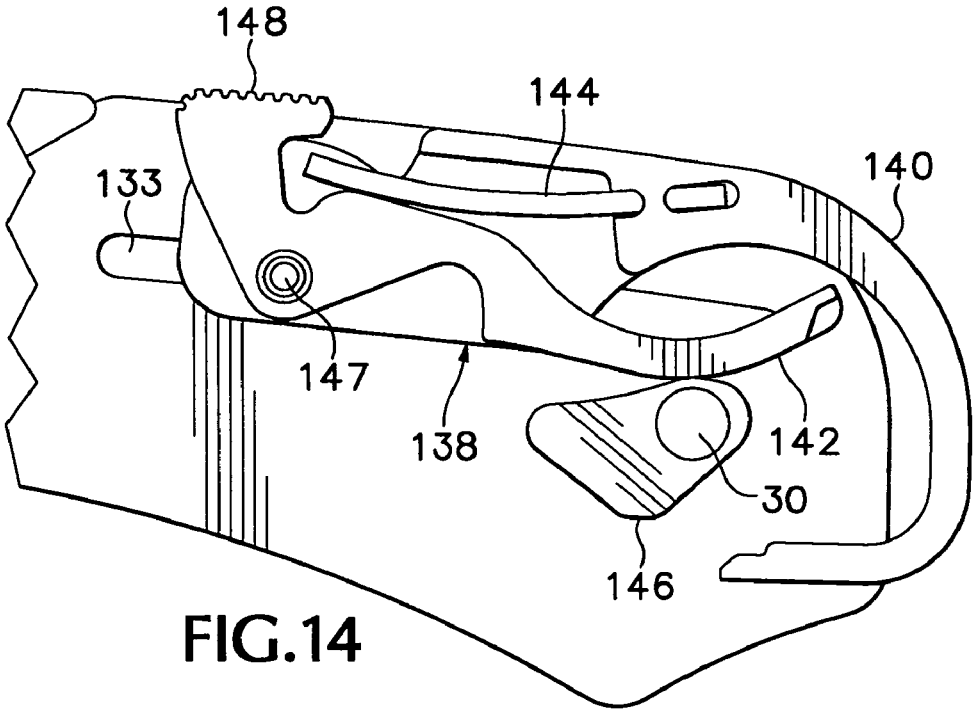
FIG. 14 is a view similar to FIGS. 12 and 13, showing the gate of the sliding carabiner open and the carabiner further retracted or slid into the cavity of the knife body.
Figure 15:
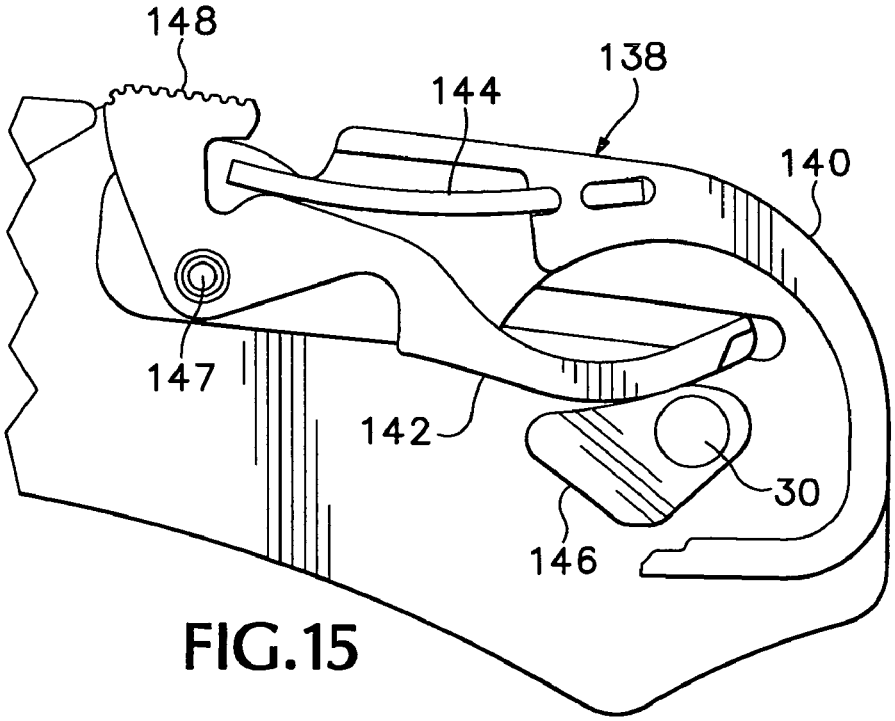
FIG. 15 is a view similar to FIGS. 12, 13, and 14, with the gate of the carabiner open and the carabiner fully retracted into the cavity of the knife body.

A gate retractor 146 also lies substantially co-planar with both the knife blade 50 and the gate 142. The gate retractor 146 is a body mounted on the liner plate 134 in line with the gate 142 and in position to act as a cam that serves as a brace to hold the gate 142 open when the carabiner 138 is partially or fully retracted, as shown in FIGS. 14 and 15. The gate retractor 146 is mounted on the blade fastener 30 to minimize the space taken in the blade cavity of the folding tool 130.

Figure 9:
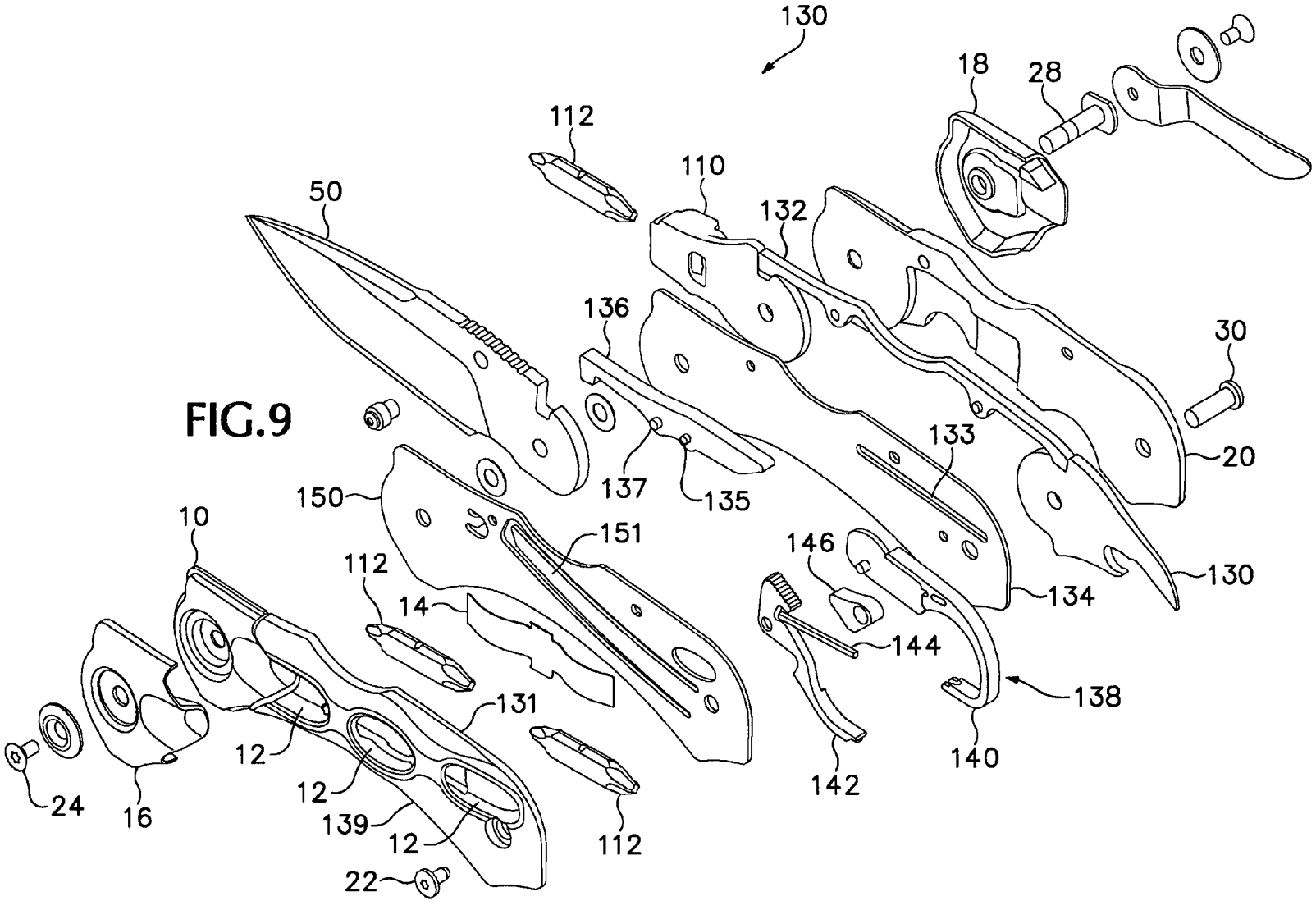
FIG. 9 is an exploded isometric view of a folding hand tool embodying another aspect of the present invention.
Figure 9A:
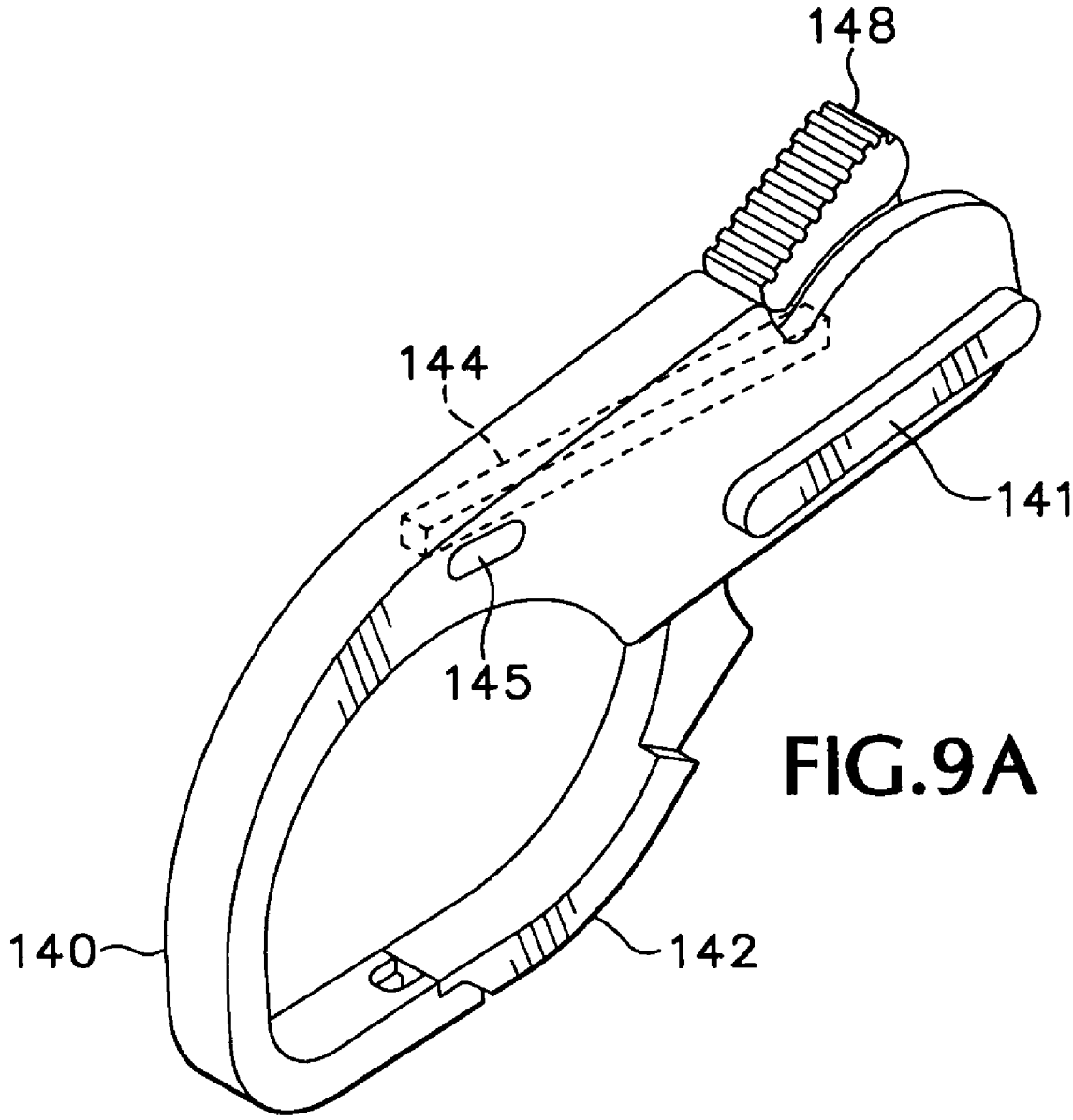
FIG. 9A is an isometric view of the carabiner shown in FIG. 9, taken from the opposite side thereof.

As shown in FIG. 11, when the carabiner is retracted into the body of the folding knife, the gate 142 is opened and rests on the gate retractor 146, allowing space for the knife blade 50 to be folded into the blade cavity 132 as well, and a part of the blade 50 occupies the space the gate 142 would otherwise occupy if not in the retracted position. By positioning the carabiner and knife blade accordingly, the blade cavity may be made substantially smaller, thereby giving the folded knife a smaller and therefore more desirable profile. The range of motion of the carabiner is controlled by a slide groove 133 defined as shown in FIG. 9. The carabiner frame 140 has a slide tab 141, shown in FIG. 9A that fits into the slide groove 133, which thus controls and limits how far the carabiner can be extracted or retracted.

As shown in FIGS. 9 and 10, a novel locking mechanism is used to secure the blade 50 in the open position. In this embodiment, the primary frame sheet 150 lies in a plane parallel to the blade 50 but does not enter the blade cavity 132 as is common with liner locks. The blade lock 136 lies along the top 131 of the folding tool 130 and in the same plane as the blade 50, but does not include a spring in this plane. Rather, the blade lock 136 rotates on a blade lock pivot axle 137 that is connected to the primary frame sheet 150, and a blade lock spring catch 135 interacts with a notch in the blade lock spring 151 portion of the primary frame sheet 150. The spring catch 135 may be a pin mounted in the blade lock 136 as shown, or the blade lock 136 may be made to include a projecting part to serve as the catch 135. In this configuration, more space is left open in the blade cavity 132 substantially coplanar with the blade 50 and carabiner frame 140 because no spring is stored or enters into the cavity either when the blade 50 is retracted into its stored position or when it is extended and locked. This configuration again gives the folding tool 130 a smaller and therefore more desirable profile with a given size of the blade 50.

As may be seen best in FIGS. 9 and 11, a U-shaped slot cut in the frame sheet 150 defines a blade position limit tab 154 that is bent out of the plane of the frame sheet 150 and extends into the blade cavity 132. The tab 154 serves as a stop to engage the root of the blade 50 and keep the blade 50 from pivoting too far into the blade cavity 132 while the blade lock 136 presses on the base of the blade 50 on the opposite side of the blade fastener 28 to urge the blade 50 to remain in its closed or folded position.

While the invention has been described in some embodiments, it should be readily apparent to those skilled in the art that many modifications, additions, and deletions may be made therein without departing from the spirit and scope of the invention. For example, each of the two general embodiments disclosed not only incorporate a blade and carabiner sharing a same blade cavity, but each has a secondary cavity containing one or more additional tools. These additional tools and additional blade cavity can be eliminated, or even more additional blade cavities can be added. Similarly, the novel features may be interchanged as desired, as by the open-assist mechanism being included in the same tool with the sliding carabiner. The invention is therefore not intended to be limited by the explicitly disclosed embodiments, but rather by the appended claims.

What is claimed is:

1. A folding tool, comprising:

a handle including a pair of elongate opposed handle side members and having a forward first end and a rearward second end, a top margin, and an opposite bottom margin spaced apart from the top margin;

first and second blade fasteners, the blade fasteners respectively securing the pair of handle side members to each other at each of the first and second ends with the handle side members being substantially parallel with each other, thereby defining a blade cavity between the two handle side members and defined by the space between the top and bottom margins, the bottom margin defining an opening into a bottom of the blade cavity;

a blade pivotable around the first blade fastener, the blade being capable of being rotated into a closed position in the blade cavity rearward of said first blade fastener or rotated out from the blade cavity in a first direction to an extended position forward of said first blade fastener, the blade entering and leaving the blade cavity through the opening defined by the bottom margin of the handle; and an open-assist flipper mounted in the handle between the two handle side members and being pivotable around the first blade fastener and capable of partial rotation around the first blade fastener independently of movement of the blade, the open-assist flipper including a finger stud exposed proximate the top margin of the handle to be engaged by a user's finger to pivot the open-assist flipper about the first blade fastener to operatively engage the blade and move the blade out from the blade cavity through the opening and in said first direction toward the extended position.

2. The folding tool of claim 1, further comprising a carabiner moveably secured at the rearward, second end opposite the blade, the carabiner sharing the blade cavity with the blade and being substantially coplanar with the blade, and being at least partially extendable from and retractable into the blade cavity.

3. The folding tool of claim 2, wherein the carabiner is pivotable around the second blade fastener.

4. The folding tool of claim 3, wherein the carabiner and blade pivot in opposite directions around the blade fasteners when being rotated out of the blade cavity.

5. The folding tool of claim 3, wherein the carabiner rotates out of the blade cavity from the top margins.

6. The folding tool of claim 3, wherein the carabiner comprises a frame and a gate.

7. The folding tool of claim 6, wherein the carabiner frame defines a cavity for receiving a part of the blade.

8. The folding tool of claim 7, wherein at least a portion of the blade nests within the cavity defined by the carabiner when both the blade and the carabiner are stored in the blade cavity.

9. The folding tool of claim 6, wherein an end of the carabiner frame may be used as a bottle opener.

10. The folding tool of claim 6, wherein the gate is biased toward the frame of the carabiner to form a closed loop.

11. The folding tool of claim 10, wherein the gate is a spring.

12. The folding tool of claim 10, wherein the gate is a flexible elongate member.

13. The folding tool of claim 10, wherein the gate is a sliding gate.

14. The folding tool of claim 6 wherein the carabiner further comprises a lock capable of locking the carabiner in a fully extended position.

15. The folding tool of claim 6, further comprising a gate lock capable of locking the gate in either an open or a closed position.

16. The folding tool of claim 2, wherein the carabiner can be extended from the blade cavity by sliding out from the second end of the handle.

17. The folding tool of claim 16, wherein the carabiner comprises a frame and a gate, and wherein the gate is pivotally connected to the frame, the gate being biased toward a closed position.

18. The folding tool of claim 17, wherein the carabiner includes a thumb retractor arranged to open the gate.

19. The folding tool of claim 18, wherein a gate retractor holds the gate in an open position when the carabiner is retracted into the blade cavity, thereby providing additional space for the blade to be stored in the blade cavity.

20. The folding tool of claim 19, wherein the blade at least partially occupies the additional space in the blade cavity.

21. The folding tool of claim 20, wherein partial movement of the finger stud from a forward position rearwardly toward the rearward second end of said handle places a part of the open-assist flipper into contact with the blade and thereby causes the blade to rotate around the first blade fastener and out from the blade cavity in said first direction toward the extended position.

22. The folding tool of claim 21, wherein the open-assist flipper comprises a member located alongside and substantially parallel with the blade and having a lug extending laterally from the member, the lug being capable of contacting a portion of the blade after the partial movement of the finger stud rearwardly from a forward position toward the rearward second end of the handle.

23. The folding tool of claim 20, wherein the finger stud is associated with the open-assist flipper so as to extend forward of said first blade fastener and past the forward first end of the handle when the blade is located in the closed position within the blade cavity and the open assist flipper is in a selected position.

24. The folding tool of claim 23, wherein the entire finger stud is able to enter the blade cavity defined by the handle when the open-assist flipper is rotated around the first blade fastener.

25. The folding tool of claim 20, further comprising a blade detent urging the blade to remain in the closed position.

26. The folding tool of claim 20, further comprising a carabiner moveably secured at the rearward second end opposite the blade, the carabiner sharing the blade cavity with the blade and being substantially coplanar with the blade, and being at least partially extendable from and retractable into the blade cavity.

27. The folding tool of claim 20, further comprising a carabiner pivotable around the second blade fastener, the carabiner sharing the blade cavity with the blade and being substantially coplanar with the blade, and being at least partially extendable and retractable into the blade cavity.

28. The folding tool of claim 20, further comprising a carabiner sharing the blade cavity with the blade and being substantially coplanar with the blade, and being partially extendable from and retractable into the blade cavity by sliding longitudinally into and out from the second end of the handle.

29. The folding tool of claim 20, further comprising a bit driver mounted on and pivotable around one of the first and second blade fasteners and capable of receiving interchangeable bits;

a recess defined in at least one of the two handle side members, the recess being capable of storing one or more interchangeable bits; and a carabiner pivotable around the second blade fastener, the carabiner sharing the blade cavity with the blade and being substantially coplanar with the blade, and being at least partially extendable from and retractable into the blade cavity.

30. The folding tool of claim 20, further comprising a bit driver mounted on and pivotable around one of the first and second blade fasteners and capable of receiving interchangeable bits;

a recess defined in at least one of the two handle side members, the recess being capable of storing one or more interchangeable bits; and a carabiner sharing the blade cavity with the blade and being substantially coplanar with the blade, and being at least partially extendable from and retractable into the blade cavity by sliding out from and into the rearward second end.

31. The folding tool of claim 20, further comprising a carabiner moveably secured at the rearward second end, opposite the blade, the carabiner sharing the blade cavity with the blade and being substantially coplanar with the blade, and being at least partially extendable from and retractable into the blade cavity;

a bit driver mounted on and pivotable around one of the first and second blade fasteners and capable of receiving interchangeable bits; and a recess defined in at least one of the handle side members for storing interchangeable bits.

32. The folding tool of claim 20, further comprising a carabiner pivotable around the second blade fastener, the carabiner sharing the blade cavity with the blade and being generally coplanar with the blade, and being partially extractable and retractable into the blade cavity;

a bit driver pivotable around one of the first and second blade fasteners and capable of receiving interchangeable bits; and at least one recess defined in at least one of the handle side members for storing interchangeable bits.

33. The folding tool of claim 20, further comprising a carabiner sharing the blade cavity with the blade and being substantially coplanar with the blade, and being at least partially extendable from and retractable into the blade cavity by sliding longitudinally into and out from the rearward second end of the handle;

a bit driver pivotable around one of the first and second blade fasteners and capable of receiving interchangeable bits; and a recess defined in at least one of the handle side members for storing interchangeable bits.

34. The folding tool of claim 22, wherein the open-assist flipper is pivotable in said first direction through an angle about the first blade fastener with respect to said handle, and wherein movement of the open-assist flipper beyond said angle places the lug into contact with the blade and thereby causes the blade to rotate in said first direction out from the closed position in the blade cavity around the first blade fastener toward the extended position.

35. The folding tool of claim 20 wherein the finger stud may be positioned so as to extend out of said blade cavity and be accessible to a user's finger adjacent the first end and the top margin of the handle when the blade is within the blade cavity.

36. The folding tool of claim 20 wherein the finger stud is movable along an arcuate path toward said rearward second end of said handle in order to cause the blade to rotate out of the blade cavity.

37. The folding tool of claim 20 wherein the blade cavity is defined by the innermost portions of said handle side members and the open-assist flipper is movable to a position with respect to the handle wherein the entire finger stud is located in the blade cavity proximate said top margin of the handle when the blade is in the extended position with respect to the handle.

38. The folding tool of claim 20 wherein when the blade is in the closed position, the finger stud is located so that the open-assist flipper can be rotated about the first blade fastener in the first direction, to move the blade toward the extended position by urging the finger stud rearwardly, toward the second end of the handle.

39. The folding tool of claim 20 wherein when the blade is in the closed position, the open-assist flipper can be rotated forwardly about the first blade fastener in a direction opposite to the first direction to a position where the finger stud is forward of the first end of the handle.

40. The folding tool of claim 22 wherein the member of the open-assist flipper located alongside and substantially parallel with the knife blade comprises a plate, and the finger stud lies substantially within a plane defined by the plate.

41. The folding tool of claim 21 wherein the finger stud is forward of the first blade fastener when the open-assist flipper comes into contact with the blade and the blade is positioned substantially within the blade cavity.

42. The folding knife of claim 20 wherein movement of the finger stud from a position forward of the first blade fastener rearwardly toward the second end of the handle to a position rearward of the first blade fastener pushes the blade in the first direction out of the blade cavity.

43. The folding tool of claim 20 wherein said finger stud has a forward position forward of the first blade fastener when the blade is in the cavity and the open-assist flipper is not operatively engaging the blade.

44. The folding tool of claim 43 wherein partial movement of the finger stud rearwardly toward the second end of the handle brings the open-assist flipper into operative engagement with the blade.

45. The folding tool of claim 44 wherein further movement of said finger stud rearwardly toward the second end of the handle moves the blade out of the cavity toward the extended position.

* * * * *

UNITED STATES PATENT AND TRADEMARK OFFICE

CERTIFICATE OF CORRECTION

PATENT NO. : 7,676,931 B2
APPLICATION NO. : 11/153639
DATED : March 16, 2010
INVENTOR(S) : Nathan E. Knight et al.

It is certified that error appears in the above-identified patent and that said Letters Patent is hereby corrected as shown below:

Column 9, line 20: “tool of claim 18” should be --tool of claim 17--;

Column 9, line 26: “tool of claim 20” should be --tool of claim 1--;

Column 9, line 41: “tool of claim 20” should be --tool of claim 1--;

Column 9, line 51: “tool of claim 20” should be --tool of claim 1--;

Column 9, line 53: “tool of claim 20” should be --tool of claim 1--;

Column 9, line 59: “tool of claim 20” should be --tool of claim 1--;

Column 9, line 65: “tool of claim 20” should be --tool of claim 1--;

Column 10, line 4: “tool of claim 20” should be --tool of claim 1--;

Column 10, line 16: “tool of claim 20” should be --tool of claim 1--;

Column 10, line 28: “tool of claim 20” should be --tool of claim 1--;

Column 10, line 39: “tool of claim 20” should be --tool of claim 1--;

Column 10, line 49: “tool of claim 20” should be --tool of claim 1--;

Column 11, line 1: “tool of claim 20” should be --tool of claim 1--;

Column 11, line 6: “tool of claim 20” should be --tool of claim 1--;

Column 11, line 10: “tool of claim 20” should be --tool of claim 1--;

Column 11, line 17: “tool of claim 20” should be --tool of claim 1--;

Column 11, line 23: “tool of claim 20” should be --tool of claim 1--;

Column 12, line 9: “tool of claim 20” should be --tool of claim 1--;

Column 12, line 9: “folding knife” should be --folding tool--;

Column 12, line 14: “tool of claim 20” should be --tool of claim 1--.

Signed and Sealed this
Tenth Day of July, 2012

David J. Kappos

David J. Kappos
*Director of the United States Patent and Trademark Office*